US005982272A

United States Patent [19]

Masuda

[11] Patent Number: 5,982,272

[45] Date of Patent: Nov. 9, 1999

[54] VARIABLE RESISTOR

[75] Inventor: Fumitoshi Masuda, Fukui-ken, Japan

[73] Assignee: Murata Manufacturing Co., Ltd., Nagaokakyo, Japan

[21] Appl. No.: 09/086,669

[22] Filed: May 29, 1998

[30] Foreign Application Priority Data

| | | | |
|---|---|---|---|
| May 30, 1997 | [JP] | Japan | 9-157741 |
| Dec. 18, 1997 | [JP] | Japan | 9-365166 |
| Apr. 2, 1998 | [JP] | Japan | 10-089816 |

[51] Int. Cl.[6] ..... H01C 10/32

[52] U.S. Cl. ..... 338/162; 338/164; 338/202

[58] Field of Search ..... 338/162, 164, 338/199, 163, 167, 171, 202

[56] References Cited

U.S. PATENT DOCUMENTS

| | | | |
|---|---|---|---|
| 4,292,660 | 9/1981 | Tasumi | 361/293 |
| 4,527,147 | 7/1985 | Arakawa | 338/162 |
| 4,884,052 | 11/1989 | Eitoku et al. | 338/202 |
| 4,998,088 | 3/1991 | Masuda | 338/162 |
| 5,053,742 | 10/1991 | Masuda | 338/162 |
| 5,293,525 | 3/1994 | Yoshimura | 338/162 |

FOREIGN PATENT DOCUMENTS 61-4162 2/1986 Japan .

*Primary Examiner*—Lincoln Donovan
*Assistant Examiner*—Richard K. Lee
*Attorney, Agent, or Firm*—Burns, Doanne, Swecker & Mathis, LLP

[57] ABSTRACT

A variable resistor reduces an inclination of a rotor caused by spring reaction of a slider, and prevents the lowering of contact pressure and deterioration in sliding performance of the slider. The resistor includes a rotor 3 and a slider 4 inside a case 1. The variable resistor also includes a resistor substrate 2 having a collector electrode 25 at a central portion of a surface thereof and having a resistive element 24 in a circular arc shape on an outer side of the collector electrode 25 substantially concentric with the central portion. The resistor substrate 2 is mounted to a lower end portion of the case 1. The slider 4 is provided with a first arm 42 having a substantially U-like shape at one end side of a base portion 41 attached to the rotor 3, having a first contact point portion 42*a* at a front end of the first arm which is brought into sliding contact with the resistive element 24 in the circular arc shape. The slider 4 is also provided with a second arm 43 and a second contact point portion 43*a* at a front end of the second arm which is brought into contact with the collector electrode. The arms are bent in directions opposed to each other, wherein the slider 4 is formed such that the first contact point portion 42*a* is disposed on the inner side of base portion 41 from a folded-bent portion 43*b* of the second arm 43, and the second contact point portion 43*a* is disposed on the inner side of the base portion 41 from a folded-bent portion 42*b* of the first arm 42. The second contact point portion 43*a* is folded back to the side of the resistor substrate 2.

21 Claims, 7 Drawing Sheets

VARIABLE RESISTOR

The present application is based on Japanese Patent Application No. 9-157741, filed on May 30, 1997, Japanese Patent Application No. 9-365166, filed on Dec. 18, 1997, and Japanese Patent Application No. 10-89816, filed on Apr. 2, 1998. The entire disclosures of all three applications are incorporated by reference herein.

BACKGROUND

1. Field of the Invention

The present invention relates to a small-sized variable resistor used in a hearing aid, a measuring instrument, a communication device, a sensor or other industrial devices.

2. Description of Related Art

In recent years, small-size and light-weight fabrication of devices has become a notable trend. For instance, the hearing aid has progressed from a device which is carried in a user's pocket, to a device which hangs from the user's ear, to a device which is inserted in the user's ear canal (referred to a canal-type device). Especially small-sized parts are required for the circuit parts of typical canal-type hearing aids.

An ultra-small type of variable resistor having, for example, an outer diameter or a side dimension of about 2 mm may be used within a hearing aid. The hearing aid may include a stable spring part, providing a slider member, which is needed in this type of variable resistor. It is difficult to downsize this type of slider structure while still achieving excellent contact performance and slide characteristics.

A slider capable of ensuring sufficient elasticity, even when it is applied to a small-sized variable resistor, has been proposed in Japanese Unexamined Patent Publication No. JP-A-61-4162. The slider described in that document has a structure in which a base portion is provided at the central portion of the slider. An arm in a channel-like shape is provided on one side of the slider and an arm in a rectangular shape is provided on the other side of the slider. The arms are folded so as to bend in the same direction at both ends of the base portion, and the arm in the rectangular shape intersects with the arm in the channel-like shape via a gap of the channel.

In the case of the slider having the structure described above, the lengths of the arms can be extended even with the small size required, and therefore a variable resistor capable of ensuring elasticity and having high reliability can be obtained.

In the case of the variable resistor described above, the arm having the rectangular shape is brought into contact with a collector electrode formed at the central portion on the surface of a resistor substrate. The arm having the channel-like shape is slid on a resistor in a circular arc shape formed concentrically at the outer periphery of the collector electrode. Accordingly, when a rotor is rotated, the slider is rotated with a contact point portion formed at the front end of the arm having the rectangular shape as its center. Further, the base portion provided at the central portion of the slider is fixed at a position which is off-center with respect to the axis of rotation of the rotor.

In the above-described stricture, a moment in a direction inclined to the rotor is formed by a spring reaction of the slider. When there is play between the rotor and a case, contact pressure of the slider, and more particularly, contact pressure between the arm having the channel-like shape and the resistor, is lowered by some amount. Further, a drawback is caused when the sliding resistance between the rotor and the case is increased due to the inclination of the rotor.

SUMMARY

Hence, it is an exemplary object of the present invention to provide a variable resistor capable of reducing an inclination of a rotor load by the spring reaction of a slider, and to also provide a variable resistor capable of preventing the lowerin, of contact pressure and deterioration in sliding performance of a slider.

It is another object of the present invention to provide a variable resistor which can be downsized and produced with reduced thickness.

In order to achieve the above-described objects, according to a first aspect of the present invention, there is provided a variable resistor comprising: a case, a rotor rotatably incorporated inside of the case, a resistor substrate incorporated inside of the case, having a collector electrode at a central portion of a surface thereof and having a resistive element in a circular arc shape at an outer side of the collector electrode substantially concentric with the collector electrode; and a slider having a base portion at a central portion thereof attached to the rotor, and having a first arm in a substantially U-like shape at one end side thereof and a first contact point portion at a front end of the first arm, and having a second arm on the other end side and a second contact point portion at a front end of the second arm. The first arm and the second arm are folded back in directions opposed to each other. The slider is formed such that the first contact point portion which is brought into sliding contact with the resistive element having the circular arc shape of the resistor substrate is disposed on an inner side of the base portion from a folded-bent portion of the second arm, and the second contact point portion which is brought into contact with the collector electrode of the resistor substrate is disposed on an inner side of the base portion from a folded-bent portion of the first arm.

The first contact point portion of the slider may be brought into sliding contact onto the resistive element in the circular arc shape of the resistor substrate with the second contact point portion which may be brought into contact with the collector electrode of the resistor substrate as a fulcrum. In this case, when the arm lengths of the first and the second arms are extended, the base portion provided at the central portion of the slider may deviate to a position remote from the center of the rotor, and the rotational balance deteriorates. According to the present invention, the first contact point portion of the slider is disposed on the inner side of the base portion from the folded-bent portion of the second arm and the second contact point portion is disposed on the inner side of the base portion from the folded-bent portion of the first arm. As such, the base portion is attached to the vicinity of the center axis portion of the rotor with a wide width, whereby the inclination of the rotor is restrained and promotion of the sliding performance and stabilization of the contact pressure are achieved.

The second contact point portion is disposed at the central portion of the resistor substrate, that is, at the center axis portion of the rotor. Accordingly, the folded-bent portion of the second arm is projected outward in the radius direction. When the rotor is provided with a diameter including the folded-bent portion, the rotor is large-sized. When the folded-bent portion is projected outward from the rotor, not only insufficient contact pressure is obtained but the folded-bent portion is brought into contact with the stopper portion at the inner face of the case, which results in unnecessary restriction of rotation. Therefore, when the folded-bent portion of the second arm is arranged at the stopper portion of the rotor as described in the one aspect of the present invention, the rear side of the folded-bent portion can be supported by the stopper portion, and sufficient contact pressure is obtained. Hence, the rotor can be prevented from being large-sized.

In the case of an ultra-small sized variable resistor, the variable resistor is often accompanied by a resistor configuration with reduced thickness. Accordingly, a slider also needs to be of an ultra-small size and low height is required as an operational dimension. When the slider is of a thin type having a small operational height, the first and the second arms may potentially interfere with each other and satisfactory spring characteristics may not be obtained. Hence, as described in another aspect of the present invention, the second contact point portion is inserted through portions of the first arm and is bent to rise from the second arm to project toward the side of the resistor substrate to a greater extent than the first arm. In this manner, the mutual interference between the first and the second arms can be prevented.

Further, in order to further promote the reliability, it is preferable to make the radius of curvature of the folded-bent portion of the second arm of the slider smaller than the radius of curvature of the folded-bent portion of the first arm, as described in yet another aspect of the present invention. That is, the folded-bent portion of the second arm does not significantly bulge in the thickness direction, and therefore the interference of the second arm with the first arm (first contact point portion) can be prevented. For example, when portions of the folded-bent portion of the second arm are bent so as to be brought into close contact with each other, the interference of the second arm with the first arm can effectively be prevented.

Further, according to another aspect of the present invention, the first contact point portion having a circular arc shape portion bent to a side of the resistor substrate is formed at the front end portion of the first arm of the slider such that the second arm is disposed on the inner side of the circular arc shape portion of the first contact point portion. Also, in this case, the interference of the second arm with the first contact point portion of the first arm can be prevented.

In a state where the second arm of the slider is bent, the slider needs to be attached accurately to the rotor such that the contact point portion coincides with the center axis of the rotor. Therefore, according to one embodiment, projections are formed which project in a direction orthogonal to the arms on the both side portions of the base portion of the slider. Also, a first concave groove is formed engaging with the base portion and second concave grooves are formed engaging with the projections in directions orthogonal to each other at the rotor. In this case, the slider can be attached to the rotor stably and firmly by engaging the slider with the two types of the concave grooves of the rotor orthogonal to each other.

In the case of, for example, a hearing aid of an ear canal type, the humidity in the mounted state is high, and/or the resistor is exposed to sweat or the like which invades the resistor and can cause failure. Therefore, a variable resistor which is an inner part of the hearing aid is preferably provided with a water-proof structure. Hence, as described in yet another aspect of the invention, a variable resistor has a structure where an O-ring is brought into press contact with and is held by a shaft for external operation and the case. The variable resistor is hermetically sealed thereby. Although a shaft portion may be projected integrally from the rotor and the shaft for external operation may be coupled to the shaft portion projected from the rotor, in such a case, portions to be sealed are at two locations (between the shaft and the rotor and between the shaft and the case) and the sealing performance is liable to deteriorate. By contrast, in the case of the structure where the shaft portion of the shaft is inserted into an insertion hole of the rotor, the portion to be sealed is confined to one location (between the shaft and the case) and the sealing performance is thereby promoted.

According to another aspect of the present invention, there is provided a variable resistor wherein an opening portion is provided at a lower face of the case. The opening portion is closed by the resistor substrate and a gap between the opening portion of the case and the resistor substrate is sealed by a resin. A first terminal conductively connected to the collector electrode and a second terminal and/or a third terminal conductively connected to the resistive element in the circular arc shape are fixed to the resistor substrate. The first terminal, the second terminal and/or the third terminal fixed to the resistor substrate are formed to be exposed on a side of a lower face of the resistor substrate. Therefore, the variable resistor is constituted as a whole as a chip part of a surface mount type. In this case, not only the lower face side of the case is sealed but the variable resistor is constituted as a chip part of a surface mount type, and accordingly, the variable resistor can be soldered to a circuit board by reflow soldering or other technique.

Further, according to another aspect of the present invention, there is provided a circuit module, wherein a predetermined number of the variable resistors according to the previous embodiment are attached to a circuit board, and the circuit board constitutes a predetermined electronic circuit. That is, each of the variable resistors is comprised of a chip-type device of small sized and reduced thickness. Also, each of the variable resistors is provided with a sealing structure. Accordingly, not only downsizing and the reduction of the thickness of a circuit module is facilitated but also a cleaning operation for removing flux can be carried out after soldering the variable resistors. Further, the moisture resistance and the weather resistance of the circuit module are promoted and the variable resistor can easily be mounted to a small-sized device, such as a hearing aid or the like.

BRIEF DESCRIPTION OF THE DRAWINGS

These and other objects, features and advantages of the invention will be apparent from the following more particular description of preferred embodiments of the invention, as illustrated in the accompanying drawings, wherein.

DETAILED DESCRIPTION

FIGS. 1–7, and FIGS. 8A, 8B, 8C, 8D and 8E show an example of a variable resistor according to one embodiment of the present invention.

Figure 1:
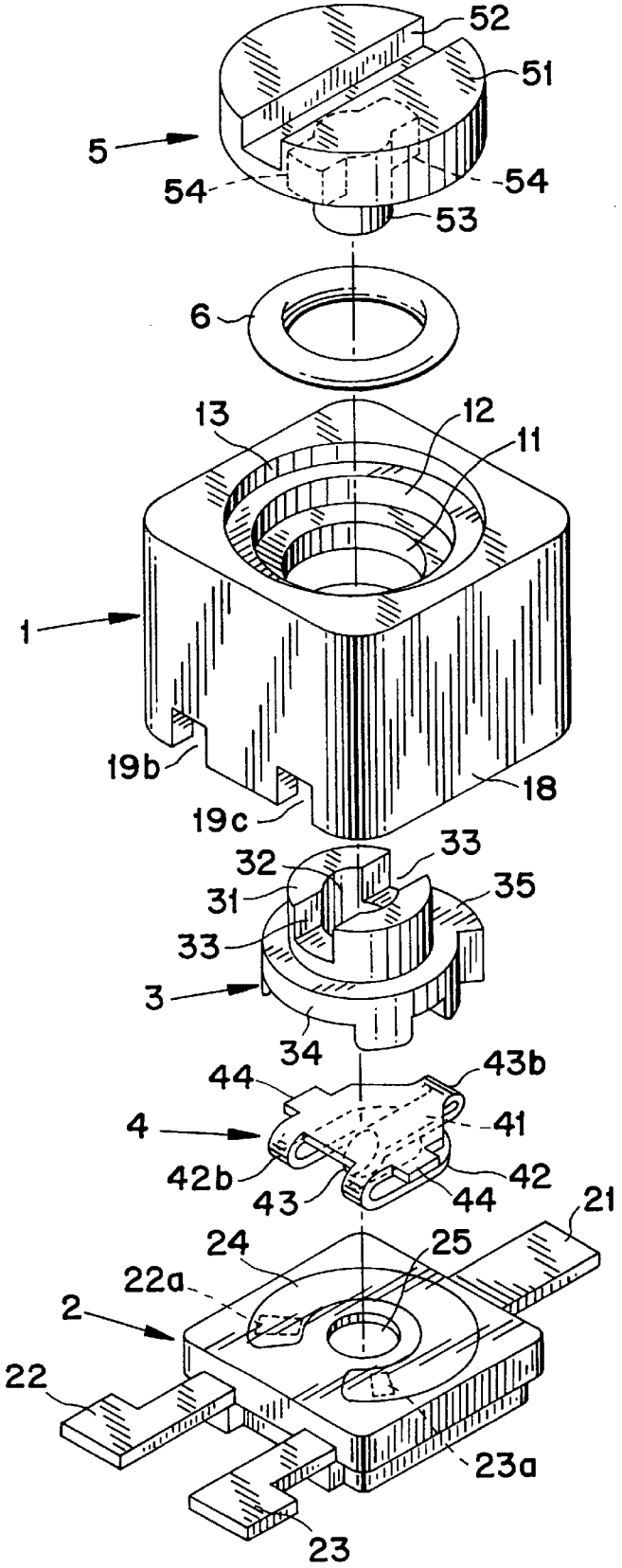
FIG. 1 is an exploded perspective view of a variable resistor according to an exemplary embodiment of the present invention.
Figure 2:
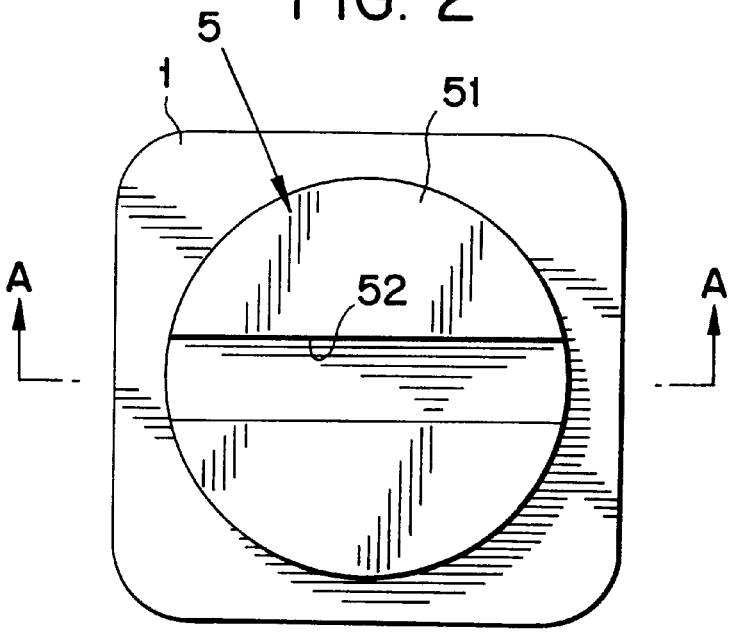
FIG. 2 is a plan view of the variable resistor of FIG. 1.

As shown by FIG. 1, the variable resistor generally comprises a case 1, a resistor substrate 2, a rotor 3, a slider 4, a shaft 5 for external operation, as well as other components to be described in the following.

Figure 5:
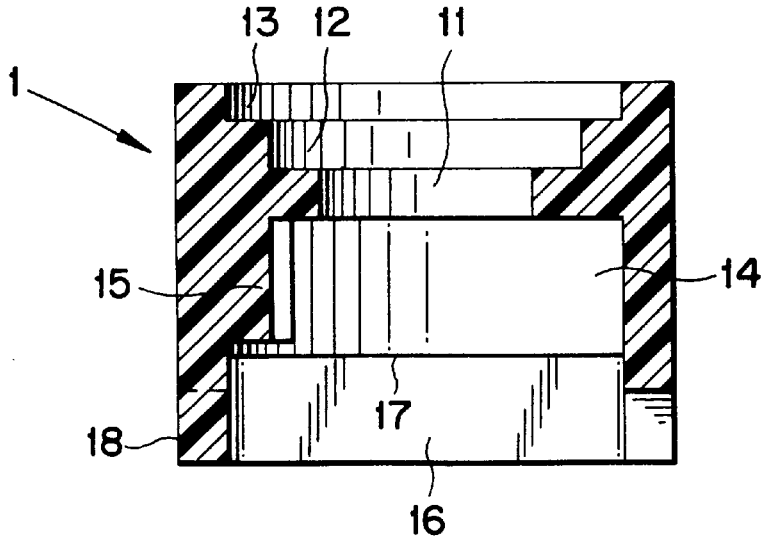
FIG. 5 is a sectional view of a case for use in the variable resistor.
Figure 6:
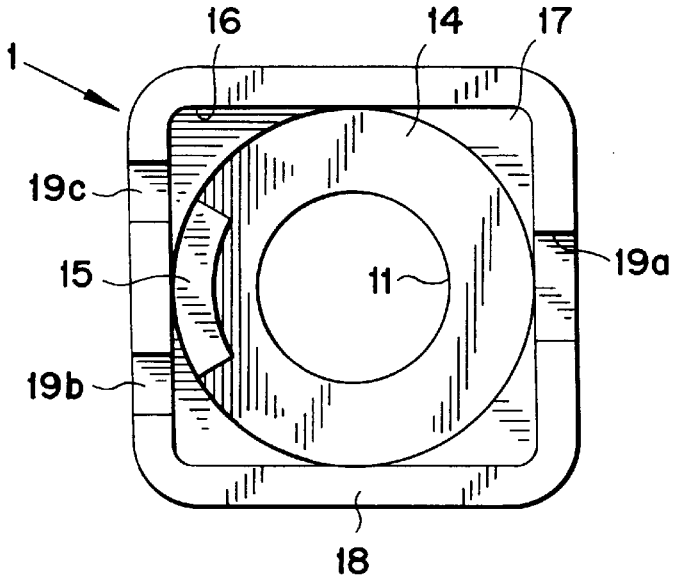
FIG. 6 is a bottom view of the case.

The case 1 is integrally formed into a square cylinder shape by heat resistant thermoplastic resin, thermosetting resin, or the like, to withstand soldering heat and to enable stable operation in a high temperature environment. As shown by FIGS. 5 and 6, on the top face of the case 1, a circular opening hole 11 and a recess portion 12 in an annular shape for arranging an O-ring 6 at its outer periphery are formed. Further, a recess portion 13 formed in an annular shape for fitting, a portion of the shaft 5 is formed at the outer periphery of the recess portion 12. An inner space 14 in a cylindrical shape for incorporating the rotor 3 and the slider 4 is formed at the inside of the case 1, and a stopper portion 15 in a fan shape is projected from a portion of the space 14. Further, a lower end opening 16 of the case 1 is formed in a square shape and a stepped face 17 is formed at the boundary between the inner space 14 and the lower end opening 16. Three notches 19*a*, 19*b* and 19*c* to which terminals 21, 22 and 23, mentioned later, are to be respectively fitted, are formed at a peripheral wall 18 surrounding the lower end opening 16.

As shown by FIG. 1, the resistor substrate 2 is formed in a square plate shape fitted to the lower end opening 16 of the case 1 and is integrally formed by a material similar to that of the case 1. A seal resin 20 (with reference to FIGS. 3 and 4) is injected into a gap between the resistor substrate 2 and the lower end opening 16 and holes at the bottom face of the resistor substrate 2 to seal the lower end opening 16 of the case 1 thereby. One terminal 21 and two terminals 22 and 23 are insert-molded to the resistor substrate 2 in a state where the terminal 21 is inserted from one side of the resistor substrate 2 toward the central portion of the substrate, and the two terminals 22 and 23 are inserted from the other side of the substrate toward the central portion thereof. A collector electrode 25 is formed by one end portion of the terminal 21 exposed at the central portion of the surface of the resistor substrate 2. Further, end portions 22*a* and 23*a* of the terminals 22 and 23 on one side are exposed at the surface of the resistor substrate 2, and a resistive element 24 in a circular arc shape is formed on (and in contact with) the exposed electrodes 22*a* and 23*a*. The resistive element 24 is formed concentrically at the outer periphery of the collector electrode 25.

Figure 3:
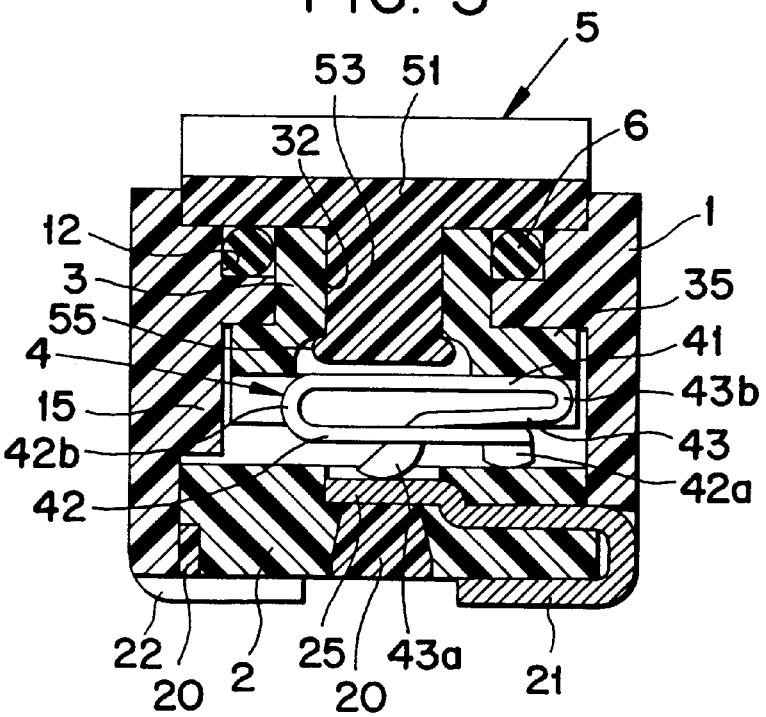
FIG. 3 is a sectional view taken along a line A—A of FIG. 2.
Figure 4:
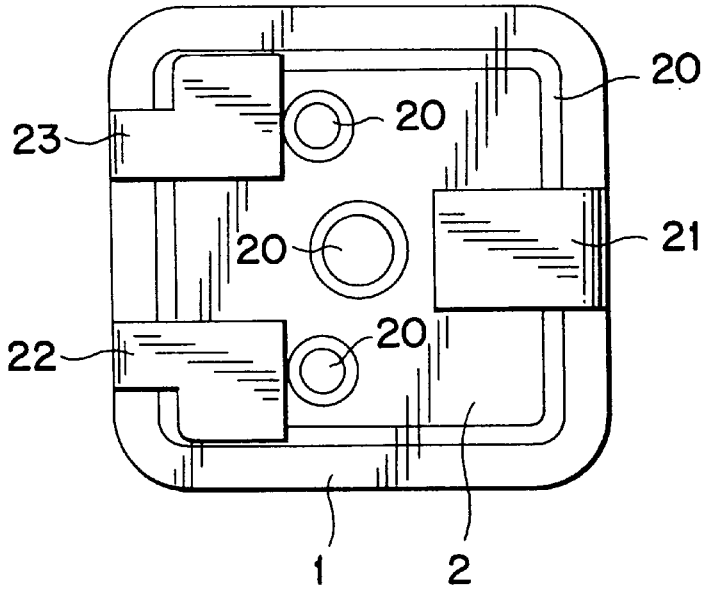
FIG. 4 is a bottom view of the variable resistor of FIG. 1.

FIGS. 3 and 4 show an example of a surface mount embodiment where terminals 21, 22 and 23 are folded back to the side of the rear face of the resistor substrate 2. However, the present invention is not limited to this embodiment. The embodiment having a structure of a face mount type in which the terminals are projected in an outward direction as shown by FIG. 1, or an embodiment having a structure of a lead type in which the terminals are folded to bend by 90° so as to be in parallel with the central axis of the case 1, can be selected for use in a commercial product design, so as to match various requirements of the market or a particular application.

The rotor 3 is also integrally formed by a material similar to that of case 1. A sleeve 31 is rotatably inserted into the opening hole 11 of the case 1 and is projected at the upper central portion. An insertion hole 32 is formed at the central portion of the sleeve 31 to penetrate in the vertical (e.g., up and down) direction. Notch grooves 33 are formed at the upper end of the sleeve 31 in the diameter direction. A flange portion 34 in a circular disk shape is formed at the lower portion of the rotor 3 and a stopper portion 35 is projected from the flange portion 34 in the radius direction. By bringing both side faces of the stopper portion 35 in contact with both side faces of the stopper portion 15 of the case 1, the rotational angle of the rotor 3 is restricted. At the lower face of the rotor 3, and in particular the bottom faces of the flange portion 34 and the stopper portion 35, a first, a second and a third recess groove 36, 37 and 38 are formed to fit and hold the slider 4.

The slider 4 is formed by a conductive metal plate having spring properties (e.g., the metal plate performs like a spring) made of a copper alloy, a stainless steel, a noble metal group alloy, or the like. Further, a noble metal or other material can be plated onto the slider, e.g., to form a gold or silver plating. In one specific example, when the conductive metal plate is made of copper alloy, nickel or copper plating can be applied on the conductive metal plate for a first layer, and then silver or gold plating can be applied over the nickel or copper plating to form a second layer. In another example, silver plating can be applied to the metal plate first, following by gold plating which is applied over the silver plating. Another method of producing the slider 4 is to form a clad metal plate by welding or contact pressing the conductive metal plate and the noble metal outer layer. As shown particularly by FIGS. 8A, 8B, 8C, 8D and 8E, the slider 4 is provided with a base portion 41 for attachment to the rotor 3 at the central portion thereof, and is provided with a first arm 42 substantially formed in a U-like shape on one end side of the base portion 41 and is provided with a second arm 43 on the other end side. The arms 42 and 43 are folded back in opposed directions respectively at folded portions 42*b* and 43*b*, (referred to here as "folded-bent portions"). At a front end of the first arm 42, a first contact point portion 42*a* that is brought into sliding contact with the resistive element 24 in a circular arc shape is formed to bend toward the side of the resistor substrate 2 (e.g., the side counter to the base portion 41). At a front end portion of the second arm 43, a second contact point portion 43*a* in a seinispherical shape that is brought into contact with the collector electrode 25 is integrally formed. Particularly, the second contact point portion 43*a* is bent to rise toward the side of the resistor substrate 2 (e.g., the side counter to the base portion 41) and accordingly, the second contact point portion 43*a* intersects with the first arm 42 (when viewing the slider 4 from a lateral direction).

Figure 7:
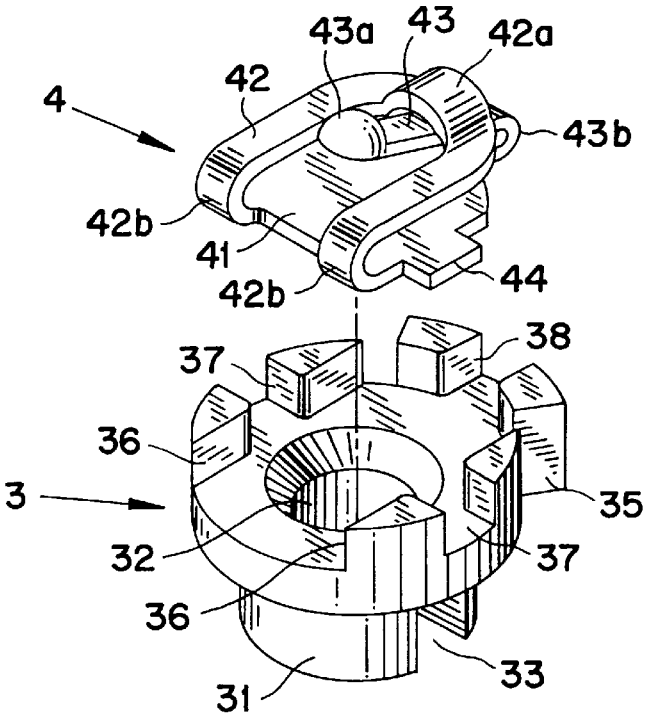
FIG. 7 is a perspective view showing a rotor and a slider from a rear side.

As shown by FIG. 7, the base portion 41 is fitted to the first recess groove 36 formed at the bottom face of the rotor 3. Further, projected portions 44 projecting orthogonally from the arms 42 and 43 are formed on both sides of the base portion 41, and the projected portions 44 are engaged with the second recess grooves 37 formed at the bottom face of the rotor 3. The first recess grooves 36 and the second recess grooves 37 pass through the axis center of the rotor 3 and are orthogonal to each other. Accordingly, by engaging the slider 4 with the two orthogonal recess grooves 36 and 37, the base portion 41 of the slider 4 is firmly positioned and held such that a center $O_1$ (with reference to FIG. 8E) coincides with the axis center of the rotor 3.

The arm lengths (the distance from a folded-bent end to the contact point portion) of the first arm 42 and the second arm 43 of the slider 4 are substantially equivalent to each other, and accordingly, the spring performance of both arms 42 and 43 are set substantially equal to each other. In a free state, the first arm 42 and the second arm 43 are projected toward the side of the resistor substrate 2 as shown by the dotted lines in FIG. 8A. The arms are bent to the solid line position by bringing the arms into press contact with the surface of the resistor substrate 2. Further, in the bent state, the second contact point portion 43*a* substantially coincides with the center $O_1$ of the base portion 41. The first contact point portion 42*a* is formed so as to be disposed on the inner side of the base portion 41 from the folded-bent end 43*b* of the second arm 43, and the contact point portion 43*a* of the second arm 43 is formed so as to be disposed on the inner side of the base portion 41 from the folded-bent end 42*b* of the first arm 42. In other words, the folded-belt ends 42*b* and 43*b* are projected outward from the contact point portions 42*a* and 43*a* Therefore, the folded-bent portion 43*b* of the second arm 43 is projected outward in the radius direction of the rotor 3. However, the folded-bent portion 43*b* is engaged with the third recess grooves 38 formed at the bottom face of the stopper portion 35 of the rotor 3. Accordingly, the folded-bent portion 43*b* does not extend outward beyond the rotor 3.

Figure 8A:
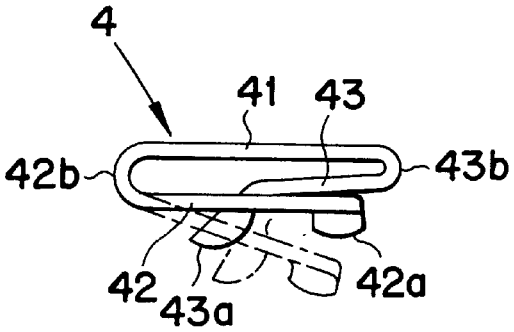
FIG. 8A is a front view of the slider according to an exemplary embodiment of the present invention.
Figure 8B:
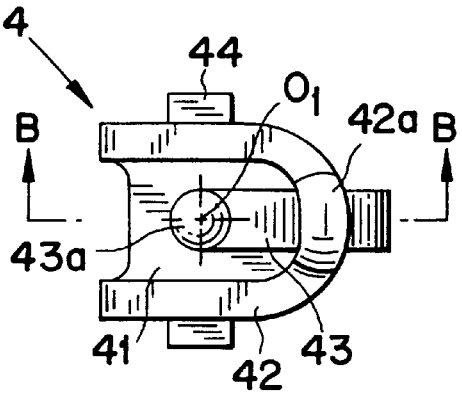
FIG. 8B is a bottom view of the slider.
Figure 8C:
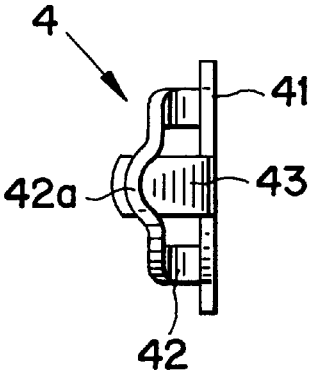
FIG. 8C is a right side view of the slider.
Figure 8D:
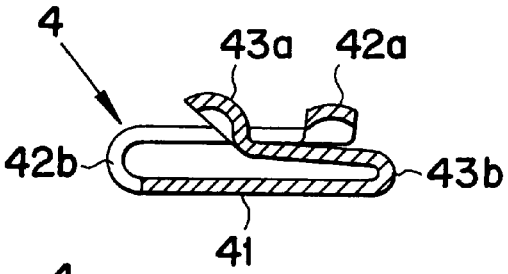
FIG. 8D is a sectional view taken from a line B—B of FIG. 8B.
Figure 8E:
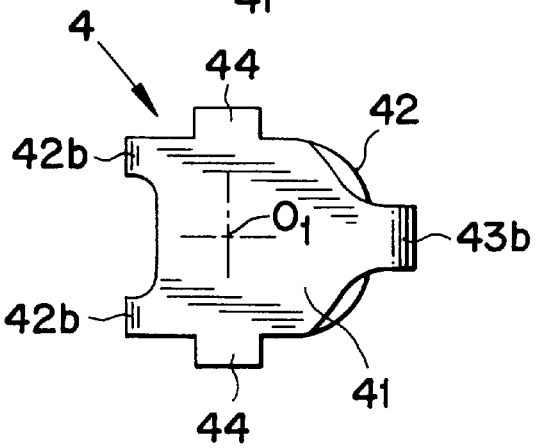
FIG. 8E is a plan view of the slider.
Figure 9:
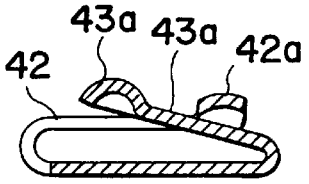
FIG. 9 is a sectional view of another embodiment of a slider according to the present invention.

As described above, a distal end of the first contact point portion 42*a* is disposed on the inner side of the folded-bent end 43*b* of the second arm 43. Accordingly, the second arm 43 inserted into the gap of the first arm 42 may interfere with the contact point portion 42*a*. That is, in the case where the second contact point portion 43*a* is not bent to rise from the second arm 43 as shown by FIG. 9, when the second contact point portion 43*a* is intended to project toward the side of the resistor substrate 2 more than the first arm 42, the second arm 43 approaches the first contact point portion 42*a*. However, when the second contact point portion 43*a* is formed in a shape where the second contact point portion 43*a* is bent to rise from the second arm 43 further to the side of the resistor substrate 2 as shown by FIG. 8A or FIG. 8D, the height of the second contact point portion 43*a* can be secured without making the second arm 43 rise higher, whereby a mutual interference between the first arm 42 and the second arm 43 can be prevented.

Further, in order to effectively prevent the mutual interference between the first arm 42 and the second arm 43, the radius of curvature of the folded-bent portion 43*b* of the second arm 43 is made smaller than the radius of curvature of the folded-bent portion 42*b* of the first arm 42. As such, the surface of the folded-bent portion 43*b* of the second arm 43 is prevented from approaching the first contact point portion 42*a*. Further, as is apparent from FIG. 8C, the first contact point portion 42*a* of the first arm 42 has a circular arc shape portion directed toward the side of the resistor substrate 2. Therefore, the second arm 43 is arranged on the inner side of the first contact point portion 42*a* having the circular arc shape portion and there is reduced concern of interference of the second arm 43 with the first arm 42 even in the case where the first arm 42 is pushed to bend toward the second arm 43.

Figure 10:
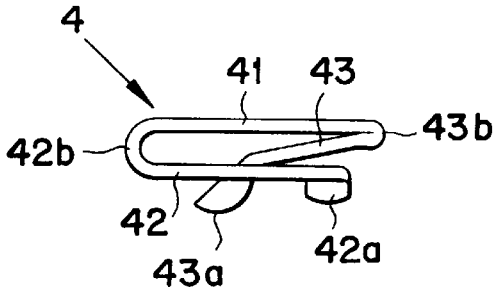
FIG. 10 is a sectional view of still another embodiment of a slider according to the present invention.

Further, when both portions of the folded-bent portion 43*b* of the second arm 43 are bent so as to be brought into close contact with each other with the resultant effect shown in FIG. 10, the distance between the second arm 43 and the first contact point portion 42*a* can be increased, and the interference can be prevented effectively even further.

Although the shaft 5 is forted by a material similar to that of the case 1, it may be formed by a metal or other material. The shaft 5 is provided with an operating portion 51 having a large diameter on one side. A tool engagement groove 52 is formed on the surface of the operating portion 51 in the direction of the diameter. A shaft portion 53 having a small diameter insertible into the insertion hole 32 of the rotor 3 is projected from the other side of the shaft 5, and two projected portions 54 for engaging with the notch grooves 33 of the rotors 3 are formed on the side face of the shaft portion 53 at symmetrical positions.

The shaft 5 is attached to the case 1 as follows. When the shaft portion 53 of the shaft 5 is inserted into the insertion hole 32 of the rotor 3 incorporated on the inner side of the case 1 in a state where the O-ring 6 is arranged at the recess portion 12 of the case 1, the projected portions 54 of the shaft portion 53 are fitted to the notch grooves 33 of the rotor 3. Accordingly, relative rotation between the shaft 5 and the rotor 3 is prevented. Further, the rotor 3 and the shaft 5 are integrated (e.g., attached together) by calking the front end of the shaft portion 53 projected toward the bottom face side of the rotor 3 with calk 55 (with reference to FIG. 3). In this state, the O-ring 6 is brought into contact with and held by the inner face of the operating portion 51 of the shaft 5 and the bottom face of the recess portion 12. Accordingly, the intermediary region between the shaft 5 and the case 1 is sealed. Particularly, by using a method where the shaft portion 53 of the shaft 5 is inserted into and fixed by the insertion hole 32 of the rotor 3 as described above, the portion to be sealed is confined to one location (between case 1 and shaft 5) and the sealing operation can be carried out effectively using a single O-ring 6.

Further, as means for coupling the shaft 5 with the rotor 3, instead of the above-described method of calking the front end of the shaft portion 53 of the shaft 5, a claw portion may be formed at the shaft portion 53 and the shaft 5 may be prevented from coming out by engaging the claw portion with the rear side of the insertion hole 32 when the shaft portion 53 is inserted into the insertion hole 32 of the rotor 3. Those skilled in the art will recognize that still other attachment mechanisms are possible.

Further, although in fitting the resistor substrate 2 into the case 1, the resistor substrate 2 is pushed in an outward direction by a repulsive force provided by the slider 4, in order to hold the resistor substrate 2 against the repulsive force in a stable manner, a claw portion may be installed at the peripheral wall 18 surrounding the lower end opening 16 of the case 1 by which the resistor substrate 2 may be embraced and held.

Figure 11:
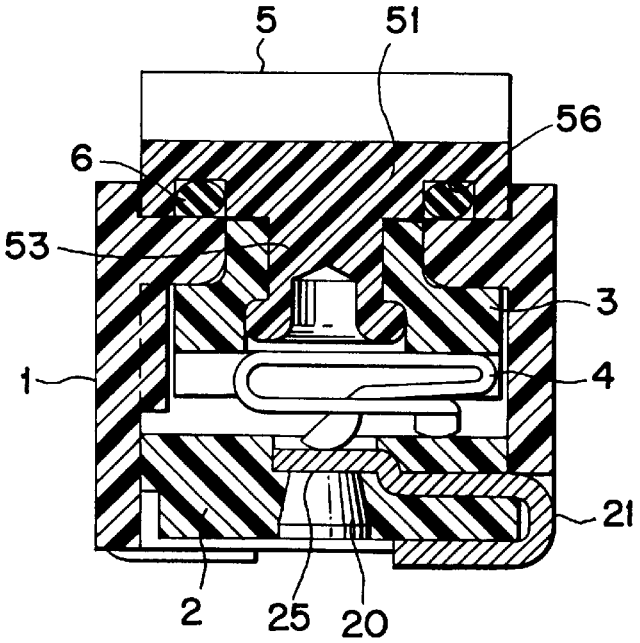
FIG. 11 is a sectional view of another exemplary embodiment of a variable resistor according to the present invention.

Although in the above-described embodiment, the recess portion 12 having an annular shape is provided at the upper face of case 1 to position the O-ring, 6, in place thereof, an incorporated groove 56 in an annular shape may be fortied at the rear face of the operating portion 51 of the shaft 5 as shown by FIG. 11. In this case, the O-ring, 6 is brought into press contact with and held by the upper face (support face) of the case 1 and the incorporated groove 56 seals the intermediary region between the case 1 and shaft 5.

In this case, the shaft 5 can be formed by, for example, a metal. The front end of the shaft portion 53 is formed in a cylindrical shape and the front end of the shaft portion 53 is calked after inserting the shaft portion 53 into the rotor 3. In this manner, the shaft 5 can simply be coupled with the rotor 3. Further, a metal which is easy to plastically deform can be used for the shaft 5, such as copper, a copper alloy, red brass, or like material. Further, plating is carried out on the surface of the metal for rust preventions As a kind of a metal for plating, gold, silver or palladium, or like material, can be used, as these materials have a pleasing ornamental appearance and prevent corrosion of the metal.

Figure 12:
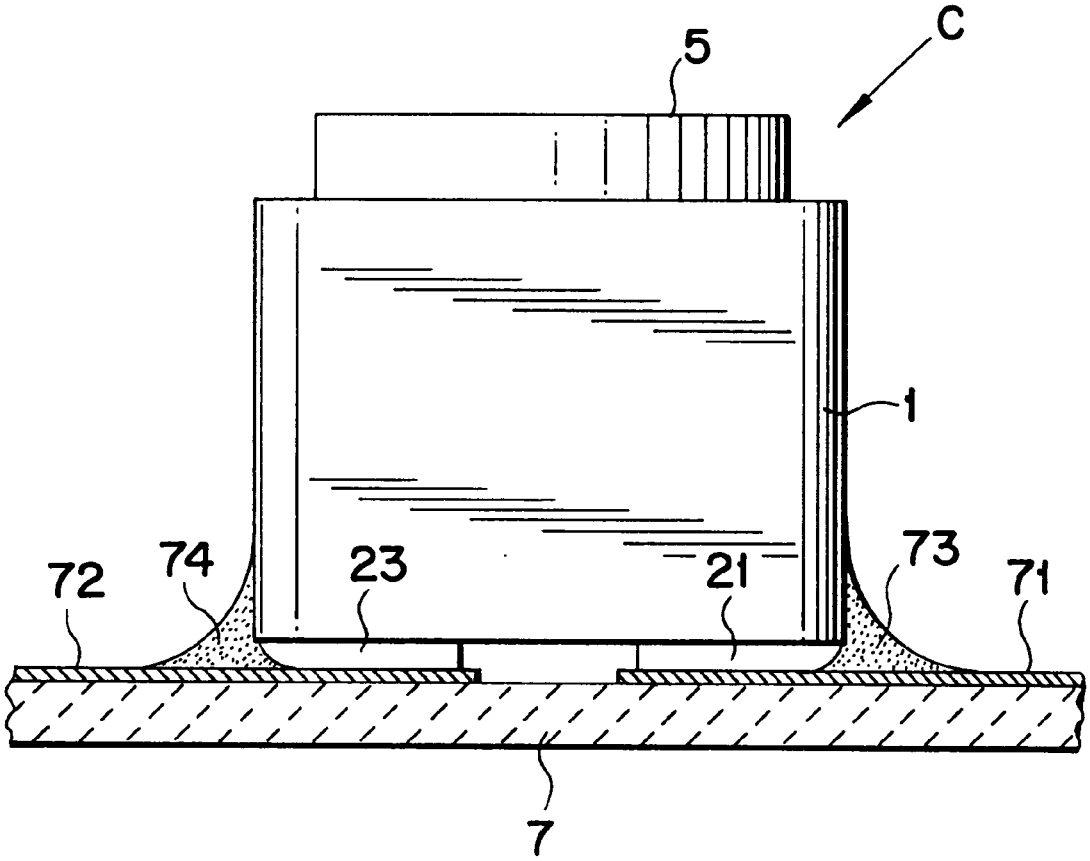
FIG. 12 is a side view of a circuit module where a variable resistor is mounted on a circuit board according an exemplary embodiment of the present invention.

FIG. 12 shows an example of a circuit module where a variable resistor C according to the present invention is mounted on a circuit board 7.

As shown by FIG. 3, the variable resistor C may be formed as a chip part of a surface mount type. In this embodiment, the terminals 21, 22 and 23 are folded back to the side of the bottom face of the resistor substrate 2. Circuit patterns 71 and 72 are formed on the circuit board 7 and the terminals 21, 22 and 23 (although the terminal 22 is not illustrated in FIG. 12) of the variable resistor C are soldered (with solder 73, 74) by reflow soldering or the like to the circuit patterns 71 and 72.

In this manner, the circuit module can easily be downsized and made thinner since the variable resistor C is fabricated as a chip part of a surface mount type. The top face of the variable resistor C is sealed firmly by the O-ring 6 and the bottom face is firmly sealed by the resin 20. Accordingly, despite the fact that a movable part (e.g., the variable resistor C) has been mounted on the circuit 7, a cleaning operation can be carried out to remove flux or the like from the circuit board 7 after mounting the variable resistor C. Further, the mounted variable resistor C can withstand use in an environment where the humidity is high, and/or where the mounted variable resistor C is exposed to sweat or the like (e.g., as in a hearing aid, in which the variable resistor C is placed in an ear canal of a user). Thus, the above-described circuit module design promotes protection against many types of harmful environments (e.g., by providing moisture and harmful weather resistance).

Although according to the above-described embodiment, in order to seal the lower end side of the case 1, the resin 20 is injected into the gap between the resistor substrate 2 and the case 1, the present invention is not limited thereto. For instance, the sealing operation may be carried out by injecting, resin on the entire tace of the lower end opening of the case 1, or the sealing operation may be carried out by using, a sealing member such as an O-ring or the like.

Further, although the O-ring is brought into press contact with and is held by the shaft 5 in order to seal the top side of the case 1, the present invention is not limited thereto. For instance, the intermediary region between the rotor and the case may be sealed in other ways (e.g., with a sealant).

Further, the outer shape of the case 1 is not limited to a square cylindrical shape but may be a circular cylindrical shape, or other shape. In this case, the outer shape of the resistor substrate 2 may not be a square plate shape, but may comprise a substantially circular plate shape resistor substrate.

Although according to the above-described embodiment, an example where the contact point portion of the slider is formed integrally with the front end portion of the arm is shown, a separate contact point member may alternatively be fixed to the front end of the arm.

Although according to the present invention, the first arm of the slider is formed substantially in a U-like shape, the substantially U-like shape concept includes not only a strict U-like shape but a channel-like shape or a shape similar thereto. Alternatively, instead of a strict U-like shape, a closed loop shape may be used in which both ends are connected to the base portion.

As is apparent from the above-described explanation, the first contact point portion of the slider is disposed on the inner side of the folded-bent end of the second arm and the second contact point portion is disposed on the inner side of the folded-bent end of the first arm, by which the base portion is attached in the vicinity of the center axis portion of the rotor while providing for relatively long arm lengths in the first and the second arms. Accordingly, the inclination of the rotor can be restrained and promotion of sliding performance and stabilization of contact pressure can be achieved. Expressed in a different way, the first contact point portion is located closer to a center $O_1$ of the base portion than the folded-bent portion of the second arm, while the second contact point portion is located closer to the center $O_1$ of the base portion than the folded-bent portion of the first arm.

Further, the folded-bent portion of the second arm projecting in an outward direction is arranged at the stopper portion of the rotor, by which the rear side of the folded-bent portion is supported by the stopper portion. Accordingly, sufficient contact pressure is obtained and the rotor need not be fabricated having a large size.

Further, when the second contact point portion of the second arm is bent to rise to project toward the side of the resistor substrate more than the first arm, as described in the present invention, an excellent spring characteristic is achieved, having reduced mutual interference between the first and the second arms.

Although the invention has been disclosed and illustrated with reference to a particular embodiment, the principles involved can be used in numerous other embodiments which will be apparent to persons skilled in the art. The invention is, therefore, to be limited only as indicated by the scope of the appended claims.

What is claimed is:

1. A variable resistor comprising:

a case;

a rotor rotatably incorporated inside of said case;

a resistor substrate incorporated inside of said case, having a collector electrode at a central portion of a surface thereof and having a resistive element in a circular arc shape at an outer side of said collector electrode and concentric to said collector electrode;

a slider having a base portion at a central portion thereof attached to said rotor, having a first arm formed in a U-like shape at one end side thereof and having a first contact point portion at a front end of said first arm, having a second arm on another end side and a second contact point portion at a front end of said second arm, said first arm and said second arm being folded back from said base portion in directions opposed to each other; and wherein said slider is formed such that said first contact point portion is brought into sliding contact with said resistive element in the circular arc shape of said resistor substrate, and is disposed on an inner side of said base portion inward from a folded-bent portion of said second arm; and said second contact point portion is brought into contact with said collector electrode of said resistor substrate, and is disposed on an inner side of said base portion inward from a folded-bent portion of said first arm.

2. The variable resistor according to claim 1, further comprising:

a stopper portion projecting outward in a radius direction of said rotor, formed at an outer peripheral portion of said rotor;

wherein said folded-bent portion of said second arm of said slider is arranged at said stopper portion of said rotor.

3. The variable resistor according to claim 1:

wherein said second contact point portion is inserted through portions of said first arm and is bent to rise from said second arm to project toward said resistor substrate to a greater extent than said first arm.

4. The variable resistor according to claim 1:

wherein a radius of curvature of said folded-bent portion of said second arm of said slider is smaller than a radius of curvature of said folded-bent portion of said first arm thereof.

5. The variable resistor according to claim 1:

wherein said first contact point portion has a circular arc shape portion bent toward said resistor substrate and is formed at the front end portion of said first arm of said slider such that said second arm is disposed on an inner side of the circular arc portion of said first contact point portion.

6. The variable resistor according to claim 1:

wherein projections projecting in a direction orthogonal to said first and said second arms are formed at both side portions of said base portion of said slider, and a first recess groove for engaging said base portion and second recess grooves engaging with said projections are formed on said rotor in directions orthogonal to each other.

7. The variable resistor according to claim 1, further comprising:

a shaft having an operating portion having a large diameter at one end portion and a shaft portion having a smaller diameter at another end portion;

wherein an insertion hole into which said shaft portion is rotatably inserted is formed in said rotor;

wherein an opening hole for inserting the shaft portion of said shaft is formed at an upper face of said case;

wherein a support face is formed at a periphery of said opening hole of said case; and an O-ring which is arranged on the support face, the shaft portion of said shaft being inserted into said insertion hole of said rotor incorporated at the inside of said case, wherein said shaft portion is held securely when said O-ring is brought into press contact with and held by said shaft and said case.

8. The variable resistor according to claim 1:

wherein an opening portion is provided at a lower face of the case, and wherein said opening portion is closed by said resistor substrate, and a gap between said opening portion of said case and said resistor substrate is sealed by a resin;

wherein a first terminal conductively connected to said collector electrode and a second terminal and/or a third terminal conductively connected to said resistive element in the circular arc shape are fixed to said resistor substrate, said first terminal, said second terminal and/or said third terminal being formed so as to be exposed on a lower face of said resistor substrate; and wherein the variable resistor is thereby formed as a chip-type part of a surface mount type.

9. A circuit module including at least one variable resistor attached to a circuit board, said at least one variable resistor comprising:

a case;

a rotor rotatably incorporated inside of said case;

a resistor substrate incorporated inside of said case, having a collector electrode at a central portion of a surface thereof and having a resistive element in a circular arc shape at an outer side of said collector electrode and concentric to said collector electrode;

a slider having a base portion at a central portion thereof attached to said rotor, having a first arm formed in a U-like shape at one end side thereof and having a first contact point portion at a front end of said first arm, having a second arm on another end side and a second contact point portion at a front end of said second arm, said first arm and said second arm being folded back from said base portion in directions opposed to each other; and wherein said slider is formed such that said first contact point portion is brought into sliding contact with said resistive element in the circular arc shape of said resistor substrate, and is disposed on an inner side of said base portion inward from a folded-bent portion of said second arm; and said second contact point portion is brought into contact with said collector electrode of said resistor substrate, and is disposed on an inner side of said base portion inward from a folded-bent portion of said first arm.

10. The circuit module according to claim 9, further comprising:

a stopper portion projecting outward in a radius direction of said rotor, formed at an outer peripheral portion of said rotor;

wherein said folded-bent portion of said second arm of said slider is arranged at said stopper portion of said rotor.

11. The circuit module according to claim 9:

wherein said second contact point portion is inserted through portions of said first arm and is bent to rise from said second arm to project toward said resistor substrate to a greater extent than said first arm.

12. The circuit module according to claim 9:

wherein a radius of curvature of said folded-bent portion of said second arm of said slider is smaller than a radius of curvature of said folded-bent portion of said first arm thereof.

13. The circuit module according to claim 9:

wherein said first contact point portion has a circular arc shape portion bent toward said resistor substrate and is formed at the front end portion of said first arm of said slider such that said second arm is disposed on an inner side of the circular arc portion of said first contact point portion.

14. The circuit module according to claim 9:

wherein projections projecting in a direction orthogonal to said first and said second arms are formed at both side portions of said base portion of said slider, and a first recess groove for engaging said base portion and second recess grooves engaging with said projections are formed on said rotor in directions orthogonal to each other.

15. The circuit module according to claim 9, further comprising:

a shaft having an operating portion having a large diameter at one end portion and a shaft portion having a smaller diameter at another end portion;

wherein an insertion hole into which said shaft portion is rotatably inserted is formed in said rotor;

wherein an opening hole for inserting the shaft portion of said shaft is formed at an upper face of said case;

wherein a support face is formed at a periphery of said opening hole of said case; and an O-ring which is arranged on the support face, the shaft portion of said shaft being inserted into said insertion hole of said rotor incorporated at the inside of said case, wherein said shaft portion is held securely when said O-ring, is brought into press contact with and held by said shaft and said case.

16. The circuit module according to claim 9:

wherein an opening portion is provided at a lower face of the case, and wherein said opening portion is closed by said resistor substrate, and a gap between said opening portion of said case and said resistor substrate is sealed by a resin;

wherein a first terminal conductively connected to said collector electrode and a second terminal and/or a third terminal conductively connected to said resistive element in the circular arc shape are fixed to said resistor substrate, said first terminal, said second terminal and/or said third terminal being formed so as to be exposed on a lower face of said resistor substrate; and wherein the variable resistor is thereby formed as a chip-type part of a surface mount type.

17. The circuit module according to claim 16:

wherein said circuit board includes circuit patterns formed on the surface thereof; and wherein at least one of said first through third terminals are soldered to respective circuit patterns.

18. The circuit module according to claim 9, wherein said circuit module is a hearing aid circuit module.

19. A variable resistor comprising:

a case;

a rotor which turns about an axis of rotation, incorporated inside of said case;

a resistor substrate incorporated inside of said case, having a collector electrode at a central portion of a surface thereof and having a resistive element in a circular arc shape at an outer side of said collector electrode and concentric to said collector electrode;

a slider having a base portion at a central portion thereof attached to said rotor, having a first arm formed in a U-like shape at one end side thereof and having a first contact point portion at a front end of said first arm, having a second arm on another end side and a second contact point portion at a front end of said second arm, said first arm and said second arm being folded back from said base portion in directions opposed to each other; and wherein said slider is formed such that said first contact point portion is brought into sliding contact with said resistive element in the circular arc shape of said resistor substrate, and said second contact point portion is brought into contact with said collector electrode of said resistor substrate;

wherein a center of said base portion is coincident with the axis of rotation of said rotor.

20. The variable resistor according to claim 1, wherein said first contact point portion is located closer to a center of said base portion than said folded-bent portion of said second arm, and said second contact point portion is located closer to the center of said base portion than said folded-bent portion of said first arm.

21. The circuit module according to claim 9, wherein said first contact point portion is located closer to a center of said base portion than said folded-bent portion of said second arm, and said second contact point portion is located closer to the center of said base portion than said folded-bent portion of said first arm.

* * * * *